US006571751B2

(12) United States Patent
Vogt

(10) Patent No.: US 6,571,751 B2
(45) Date of Patent: Jun. 3, 2003

(54) METHOD AND APPARATUS FOR COOLING FAN CONTROL ALGORITHM

(75) Inventor: Bryan A. Vogt, Naperville, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/851,455

(22) Filed: May 8, 2001

(65) Prior Publication Data

US 2002/0166517 A1 Nov. 14, 2002

(51) Int. Cl.[7] ..... F01P 7/02
(52) U.S. Cl. ..... 123/41.12
(58) Field of Search ..... 123/41.11, 41.12, 123/41.49

(56) References Cited

U.S. PATENT DOCUMENTS 5,165,377 A 11/1992 Hosseini
5,307,644 A * 5/1994 Cummins et al. ..... 123/41.12
5,531,190 A * 7/1996 Mork ..... 123/41.12
5,667,045 A 9/1997 Cummings
5,937,979 A 8/1999 Cummings
5,947,247 A 9/1999 Cummings
6,045,482 A 4/2000 Nishar et al.
6,113,351 A * 9/2000 McCallum et al. ..... 123/41.49
6,129,193 A 10/2000 Link
6,216,778 B1 * 4/2001 Corwin et al. ..... 165/299
6,273,034 B1 * 8/2001 Hawkins et al. ..... 123/41.11
6,308,665 B1 * 10/2001 Lewis ..... 123/41.12

* cited by examiner

*Primary Examiner*—Noah P. Kamen
(74) *Attorney, Agent, or Firm*—James R Smith

(57) ABSTRACT

In an embodiment of the present invention, a method and apparatus for controlling a fan on a work machine is provided. The method includes the steps of sensing a temperature of air at an inlet manifold, sensing a temperature of an engine coolant fluid, sensing a temperature of a hydraulic fluid, and sensing a temperature of a transmission fluid. The method also includes the step of controlling the fan responsive to at least one of the sensed temperatures.

14 Claims, 3 Drawing Sheets

METHOD AND APPARATUS FOR COOLING FAN CONTROL ALGORITHM

TECHNICAL FIELD

This invention relates to the control of a cooling fan on a work machine, and, more particularly, to a control algorithm which controls the speed of a cooling fan as needed by controlling the amount of power provided to the fan.

BACKGROUND

A work machine, such as a wheel loader, hydraulic excavator, forwarder, or track-type tractor typically generates a great deal of engine heat during operation. This engine heat is often exacerbated by a high ambient temperature at the work location. Additionally, in an effort to make the machine operate more quietly, the engine compartment of the machine is often heavily muffled and insulated, which also raises the engine compartment temperature. It is therefore desirable to run a cooling fan or other airflow provider to draw, push, or otherwise direct heat away from the engine compartment.

Conversely, often regulations require that the noise produced by the work machine be less than a predetermined level or rate. As much of the noise produced by the machine is caused by the cooling fan of the machine, it is thus advantageous to regulate the operation of the cooling fan to provide the least amount of noise while still maintaining the desired cooling characteristics. This is often done by running the cooling fan at a reduced speed or by selectively turning the fan off.

An example of a cooling fan control algorithm is disclosed in U.S. Pat. No. 6,045,482, issued Apr. 4, 2000 to Dipchand V. Nishar et al. (hereafter referenced as '482). '482 discloses a system for controlling air flow to an engine cooling system which includes a control computer responsive to a number of engine and/or engine accessory operating conditions, and to various engine operational states to control operation of an engine cooling device. Examples of the engine and/or engine accessory operating conditions include engine coolant temperature, rate of change of engine coolant temperature, intake manifold air temperature, air conditioner refrigerant pressure, and fan speed factor.

Accordingly, the art has sought an apparatus and method of a cooling fan control system for a work machine which: measures one or more temperature inputs from the work machine; controls the cooling fan without requiring that the cooling fan be monitored; controls the cooling fan to provide a reduction in noise produced by the work machine; proportionally modulates a pump which directly drives a motor; limits the rate of change of the proportional modulation to prevent driver diagnostics and hydraulic system instabilities; provides lower fuel consumption; provides reduced overcooling of the engine inlet air and hydraulic fluid in cold ambient conditions; provides greater operator comfort; may be used in a timely and efficient manner; and is more economical to manufacture and use.

The present invention is directed to overcoming one or more of the problems as set forth above.

SUMMARY OF THE INVENTION

In an embodiment of the present invention, a method for controlling a fan on a work machine is provided. The method includes the steps of producing an inlet manifold air temperature signal responsive to a sensed temperature of air at an inlet manifold, producing an engine coolant temperature signal responsive to a sensed temperature of an engine coolant fluid, producing a hydraulic sump temperature signal responsive to a sensed temperature of a hydraulic fluid, and producing a transmission lube oil temperature signal responsive to a sensed temperature of a transmission fluid. The method also includes the steps of reading the inlet manifold air temperature signal, engine coolant temperature signal, hydraulic sump temperature signal, and transmission lube oil temperature signal and responsively calculating a fan current value; and reading the fan current value and responsively controlling the fan.

In an embodiment of the present invention, an apparatus for controlling an engine cooling fan is provided. The apparatus includes one or more temperature sensors, an electronic control module, and a fan control device. The temperature sensors are adapted to measure one or more temperatures and responsively produce one or more temperature signals. The electronic control module is adapted to receive the temperature signals and responsively produce a fan current signal. The fan control device is adapted to receive the fan current signal and responsively control a driving force provided to the engine cooling fan.

In an embodiment of the present invention, a method for use in an engine cooling system for a work machine is provided. The method includes the steps of generating a current signal based on at least one temperature input, and reading the current signal and responsively providing power to a cooling member.

DETAILED DESCRIPTION

A preferred embodiment of the present invention provides a method and apparatus of controlling a fan on a work machine. The following description uses a wheel loader as an example only. This invention may be applied to other types of work machines, for example, hydraulic excavators or track-type tractors.

Figure 1:
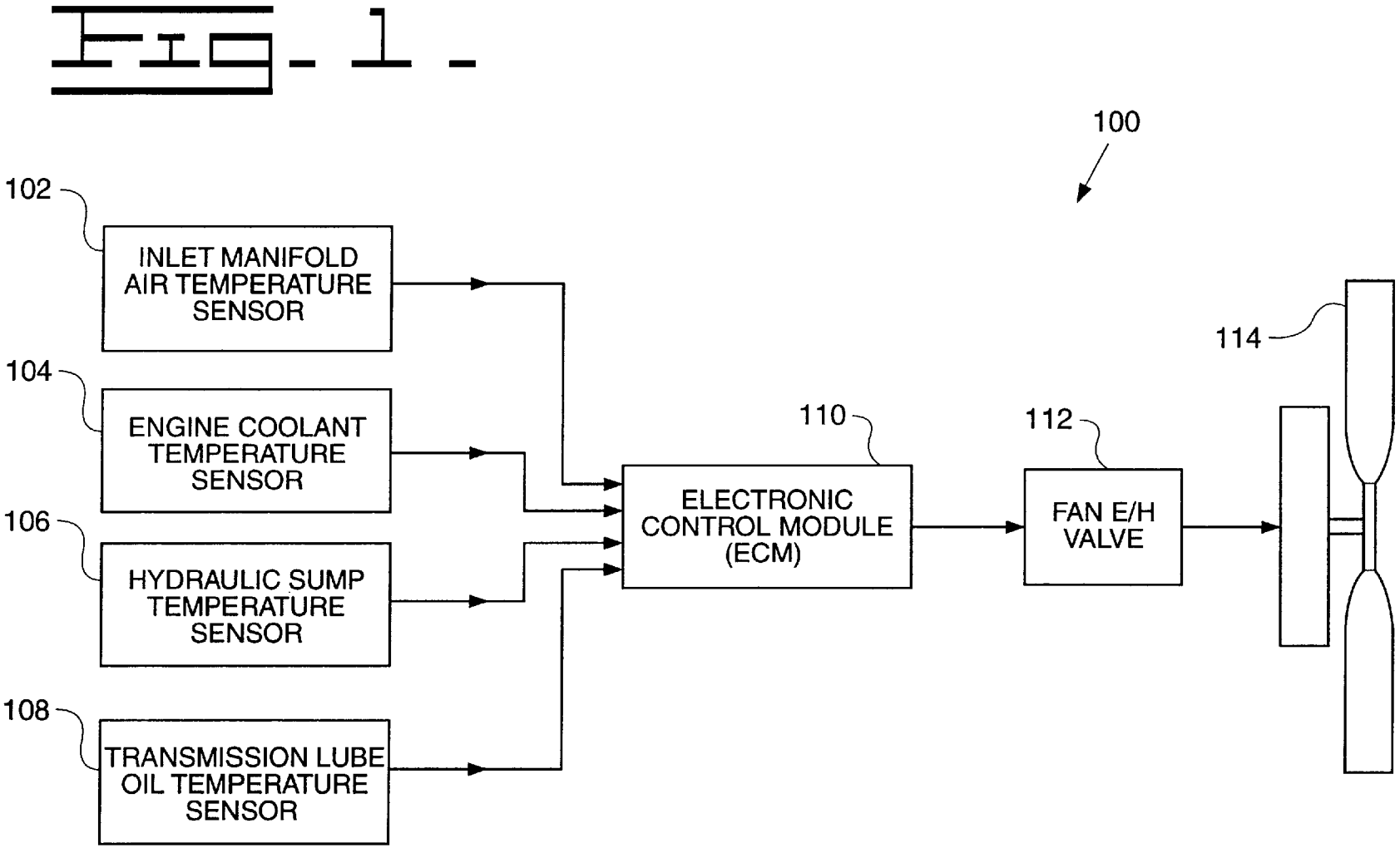
FIG. 1 is a block diagram of a preferred embodiment of the present invention.

As shown in FIG. 1, a cooling fan control system 100 for a work machine includes an inlet manifold air temperature sensor 102, an engine coolant temperature sensor 104, a hydraulic sump temperature sensor 106, and a transmission lube oil temperature sensor 108. Any other temperature properties of the work machine may be sensed and monitored, additionally or substitutionally to these four, without departing from the spirit and scope of the present invention. The inlet manifold air temperature sensor 102 produces an inlet manifold air temperature signal ($t_i$) responsive to a sensed temperature of air at an inlet manifold of a work machine. The engine coolant temperature sensor 104 produces an engine coolant temperature signal ($t_e$) responsive to a sensed temperature of the engine coolant of the work machine. The hydraulic sump temperature sensor 106 produces a hydraulic sump air temperature signal ($t_h$) responsive to a sensed temperature of hydraulic fluid in the hydraulic sump of the work machine. The transmission lube oil temperature sensor 108 produces an transmission lube oil temperature signal ($t_t$) responsive to a sensed temperature of the lubrication oil of a transmission of the work machine.

An electronic control module (hereafter referenced as ECM) 110 reads the $t_i$, $t_e$, $t_h$, and $t_t$ signals and responsively produces a fan current value (I) which controls the hydraulic fluid flow through a fan electrohydraulic (E/H) valve 112 which powers a cooling fan 114 to provides airflow to the engine compartment of the work machine.

It is to be understood that the element referenced herein as a cooling fan 114 can include one or more single, dual, or variable speed fans, or any other electrically, electronically, or electrohydraulically actuable device which operates to provide cooling airflow to the engine compartment.

In a preferred embodiment, the ECM 110 is a computer including a microprocessor chip manufactured by Motorola Inc. located in Schaumburg, Ill. However, other suitable ECMs are known in the art, any one of which could be readily and easily used in connection with an embodiment of the present invention. A specific program code can be readily and easily written from the flowchart, shown in FIG. 2, in the specific assembly language or microcode for the selected microprocessor chip.

The computer is adapted to receive the $t_i$, $t_e$, $t_h$, and $t_t$ signals and provide a fan current value (I) in response to the $t_i$, $t_e$, $t_h$, and $t_t$ signals. Preferably the computer is one of many readily available computers capable of processing numerous instructions. It should be appreciated that the computer may include multiple processing units configured in a distributed structure environment and forming a system.

Figure 2:
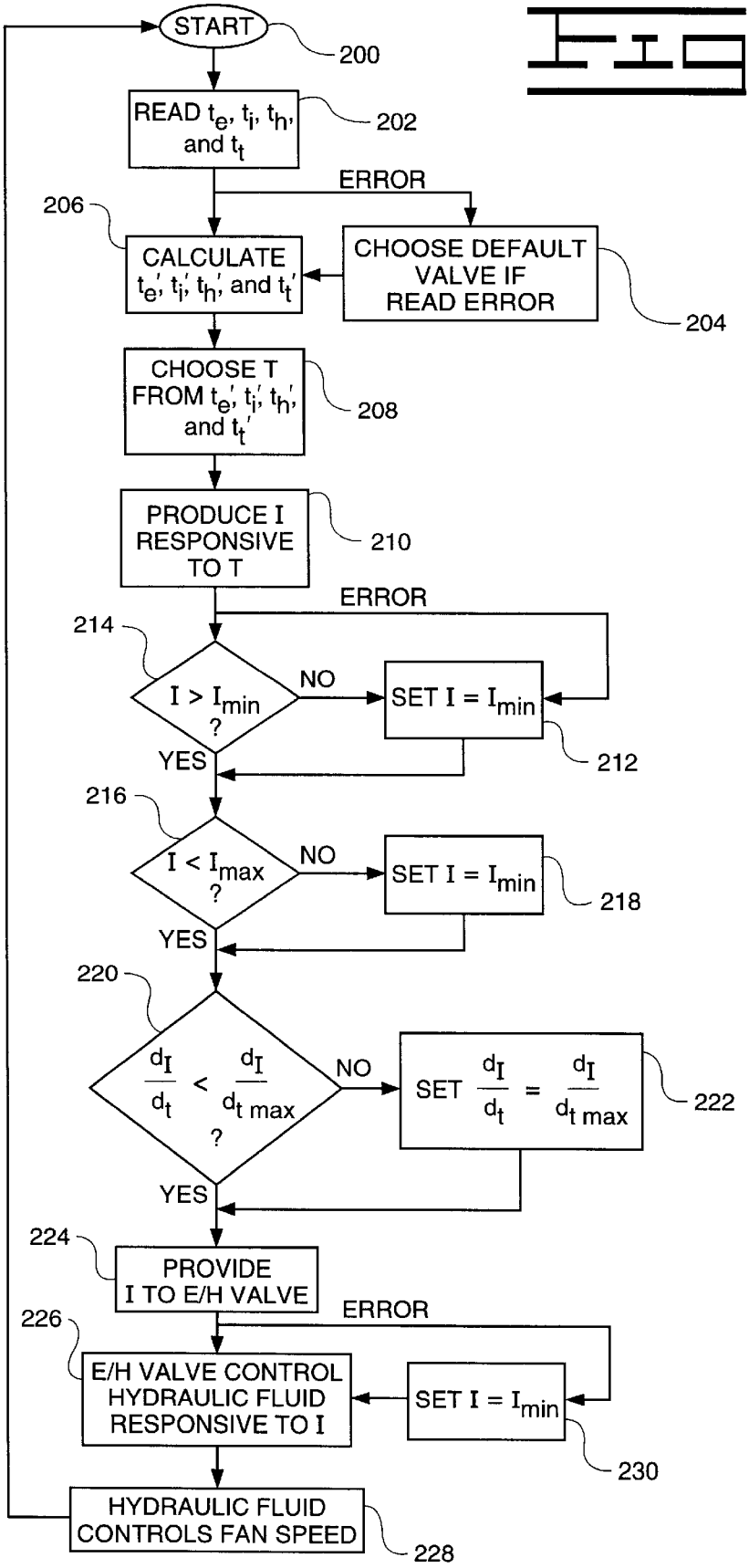
FIG. 2 is a flowchart of an algorithm based on a preferred embodiment of the present invention.

FIG. 2 is a flowchart detailing an algorithm based on a preferred embodiment of the present invention. The execution of the program starts at first control block 200. The $t_i$, $t_e$, $t_h$, and $t_t$ signals are read by the ECM 110 at second control block 202. If there is an error associated with the reading of any one of the $t_i$, $t_e$, $t_h$, and $t_t$ signals (that is, if any of these signals is unavailable or improper), a default value is chosen for the erroneous signal at third control block 204. Whether or not there is a read error, the ECM 110 then calculates a corresponding error signal $t_i'$, $t_e'$, $t_h'$, and $t_t'$ for each of the $t_i$, $t_e$, $t_h$, and $t_t$ signals at fourth control block 206. These error signals $t_i'$, $t_e'$, $t_h'$, and $t_t'$ are calculated responsive to the original $t_i$, $t_e$, $t_h$, and $t_t$ signals and to predetermined multiplier values and target values for each of the original $t_i$, $t_e$, $t_h$, and $t_t$ signals.

At fifth control block 208, a controlling temperature signal (T) is chosen from the error signals $t_i'$, $t_e'$, $t_h'$, and $t_t'$. The choice of T is made by a predetermined method and can be adjusted through adjustment of the chosen predetermined multiplier values and target values. One option for choosing which error signal $t_i'$, $t_e'$, $t_h'$, and $t_t'$ to use as T is to choose the highest of the error signals $t_i'$, $t_e'$, $t_h'$, and $t_t'$.

Regardless of the error signal $t_i'$, $t_e'$, $t_h'$, and $t_t'$ chosen, a PI controller or other hardware or software device produces the fan current value (I) responsive to T at sixth control block 210. With T as the input, I may be produced through the use of an algorithm, lookup table, chart, any combination thereof, or any other method which permits a predictable output from an input. If there is in error in the production of I, I is set to a predetermined minimum fan current value ($I_{mm}$) at seventh control block 212.

Whether or not there is an error associated with I, I is compared to $I_{min}$ at first decision block 214. If I is less than $I_{min}$, I is set to $I_{min}$ at seventh control block 212. If I is greater than $I_{min}$, no change is made. Control then passes to second decision block 216.

At second decision block 216, I is compared to $I_{max}$. If I is greater than $I_{max}$, I is set to $I_{max}$ at eighth control block 218. If I is less than $I_{max}$, no change is made. Control then passes to third decision block 216.

At third decision block 220, the rate of change of I (dI/dt) is compared to a maximum rate of change value $(dI/dt)_{max}$. If dI/dt is greater than $(dI/dt)_{max}$, dI/dt is set to $(dI/dt)_{max}$ at ninth control block 222. If dI/dt is less than $(dI/dt)_{max}$, no change is made. Control then passes to tenth control block 224.

At tenth control block 224, a signal corresponding to I is provided to the fan electrohydraulic (E/H) valve 112. At eleventh control block 226, the fan E/H valve controls the hydraulic fluid supplied to the cooling fan 114 responsive to the value of I. At twelfth control block 228, the hydraulic fluid controls the cooling fan 114 speed (F). Advantageously, if there is an error providing the signal corresponding to I to the fan electrohydraulic (E/H) valve 112, I is assumed to be $I_{min}$ at thirteenth control block 230 and control then returns to eleventh control block 226. Regardless of the presence of an error, the program logic returns to first control block 200 from twelfth control block 228.

The logic of FIG. 2 is performed every control loop to help regulate F to be the minimum speed necessary for providing a desired airflow to the work machine. However, those skilled in the art know that aspects of the control of F could be determined at other frequencies depending on factors like the read frequencies of the temperature sensors without deviating from the invention as defined by the appended claims.

While aspects of the present invention have been particularly shown and described with reference to the preferred embodiment above, it will be understood by those skilled in the art that various additional embodiments may be contemplated without departing from the spirit and scope of the present invention. For example, the temperature sensors may read different temperatures than the examples given above, the cooling fan may be an air-providing device other than a traditional fan, the cooling fan may be operated electrically or electronically rather than electrohydraulically, or the operator may be prompted for input if a signal error occurs. However, a device or method incorporating such an embodiment should be understood to fall within the scope of the present invention as determined based upon the claims below and any equivalents thereof.

INDUSTRIAL APPLICABILITY

As discussed herein and shown in the accompanying drawings, the present invention provides a method and apparatus of a cooling fan control system 100. In operation, it is desirable to control the cooling fan 114 of a work machine such that the cooling fan 114 operates as little as possible while still maintaining proper airflow to the engine compartment (not shown) of a work machine (not shown).

In operation, the ECM 110 receives at least one temperature signal from at least one temperature sensor. Examples of these signals are an inlet manifold air temperature signal ($t_i$), an engine coolant temperature signal ($t_e$), a hydraulic sump air temperature signal ($t_h$), and an transmission lube oil temperature signal ($t_t$). These temperatures are modified to provide error signals $t_i'$, $t_e'$, $t_h'$, and $t_t'$, which are calculated responsive to the original $t_i$, $t_e$, $t_h$, and $t_t$ signals and to predetermined multiplier values and target values for each of the original $t_i$, $t_e$, $t_h$, and $t_t$ signals. One of the error signals $t_i'$, $t_e'$, $t_h'$, and $t_t'$ is then chosen, according to predetermined criteria, to be the controlling temperature signal (T).

Once T is chosen, a proportional controller or other well-known hardware or software device produces the fan current value (I) responsive to T. I is then limited between predetermined maximum and minimum values. Advantageously, the maximum and minimum values stem from the flow compensator on a variable hydraulic pump and from the pressure compensator on a variable displacement piston pump, respectively. After I is limited between maximum and minimum values, the rate of change of I with respect to time is limited to a predetermined maximum rate value. Preferably, this maximum rate value prevents driver diagnostics and hydraulic system instabilities.

Figure 3:
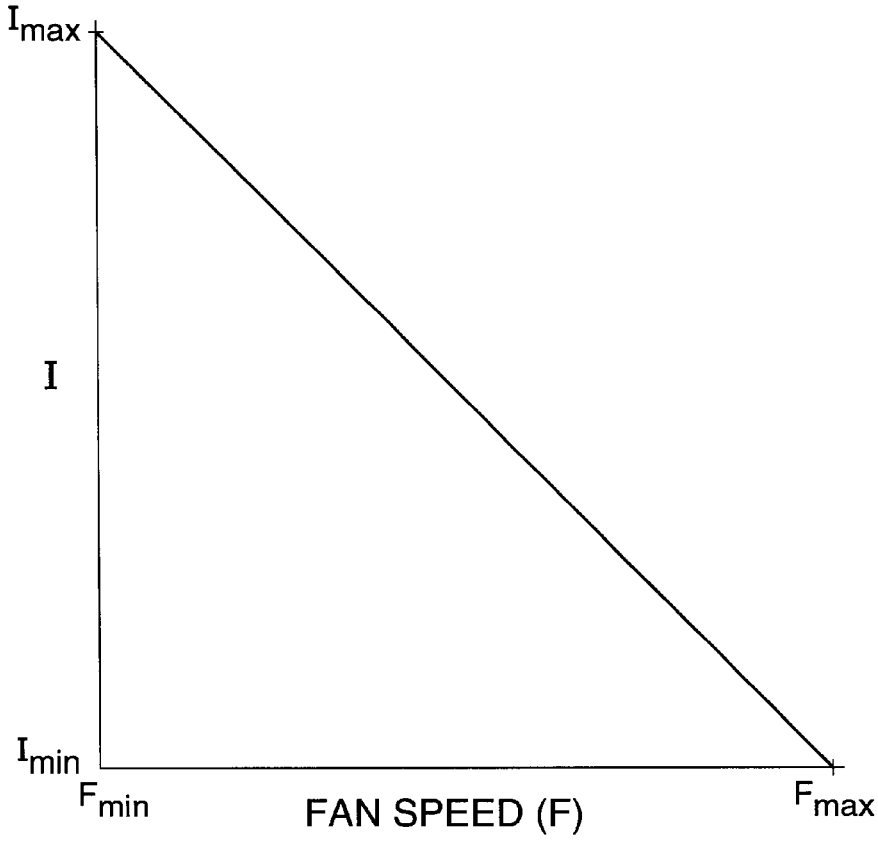
FIG. 3 is a graph of the inverse relationship between the fan current value (I) and the cooling fan 114 speed (F) in a preferred embodiment of the present invention.

FIG. 3 illustrates the inverse relationship between the fan current value (I) and the cooling fan 114 speed (F) in a preferred embodiment of the present invention. FIG. 3 is meant to be illustrative and does not necessarily represent actual values of this inverse relationship. As can be readily seen, the relationship is constructed so that an absence of the I input results in a maximum fan speed. This function prevents overheating of the work machine due to a lost signal.

Controlling I controls current to the proportional E/H valve, which responsively governs the hydraulic fluid powering the cooling fan 114. Optionally, I can be used to control any regulator supplying power to any cooling device.

The method and apparatus of certain embodiments of the present invention, when compared with other apparatus and methods, may have the advantages of: measuring one or more temperature inputs from the work machine; controlling the cooling fan without requiring that the cooling fan be monitored; controlling the cooling fan to provide a reduction in noise produced by the work machine; proportionally modulating a pump which directly drives a motor; limiting the rate of change of the proportional modulation to prevent driver diagnostics and hydraulic system instabilities; providing lower fuel consumption; providing reduced overcooling of the engine inlet air and hydraulic fluid in cold ambient conditions; providing greater operator comfort; use in a timely and efficient manner; and being more economical to manufacture and use. Such advantages are particularly worthy of incorporating into the design, manufacture, and operation of wheel loaders and other work machines. In addition, the present invention may provide other advantages that have not been discovered yet.

It should be understood that while a preferred embodiment is described in connection with a wheel loader, the present invention is readily adaptable to provide similar functions for other work machines. Other aspects, objects, and advantages of the present invention can be obtained from a study of the drawings, the disclosure, and the appended claims.

What is claimed is:

1. A method for controlling a fan on a work machine, the method comprising the steps of:

sensing a temperature of air at an inlet manifold;

sensing a temperature of an engine coolant fluid;

sensing a temperature of a hydraulic fluid;

sensing a temperature of a transmission fluid;

calculating a fan current value based on at least one of said temperatures; and limiting at least one of: (i) the fan current value between a minimum fan limit and a maximum fan limit, and (ii) a rate of change of the fan current value to a predetermined rate limit value.

2. The method of claim 1, further comprising the steps of:

producing an inlet manifold air temperature signal responsive to a sensed temperature of air at an inlet manifold;

producing an engine coolant temperature signal responsive to a sensed temperature of an engine coolant fluid;

producing a hydraulic sump temperature signal responsive to a sensed temperature of a hydraulic fluid;

producing a transmission lube oil temperature signal responsive to a sensed temperature of a transmission fluid;

reading the inlet manifold air temperature signal, engine coolant temperature signal, hydraulic sump temperature signal, and transmission lube oil temperature signal and responsively calculating said fan current value; and reading the fan current value and responsively controlling the fan;

signal, engine coolant temperature error signal, hydraulic sump temperature error signal, and transmission lube oil temperature error signal which is unavailable or improper.

3. The method of claim 2, further comprising the steps of:

calculating an inlet manifold air temperature error signal responsive to the inlet manifold air temperature signal, an inlet manifold air temperature multiplier, and an inlet manifold air temperature target value;

calculating an engine coolant temperature error signal responsive to the engine coolant temperature signal, an engine coolant temperature multiplier, and an engine coolant temperature target value;

calculating a hydraulic sump temperature error signal responsive to the hydraulic sump temperature signal, a hydraulic sump temperature multiplier, and a hydraulic sump temperature target value;

calculating a transmission lube oil temperature error signal responsive to the transmission lube oil temperature signal, a transmission lube oil temperature multiplier, and a transmission lube oil temperature target value;

choosing one of the inlet manifold air temperature error signal, engine coolant temperature error signal, hydraulic sump temperature error signal, and transmission lube oil temperature error signal as the controlling temperature signal; and producing the fan current value responsive to the controlling temperature signal.

4. The method of claim 3, further comprising the step of:

reading the fan current value and responsively modulating power to a fan electrohydraulic valve to control the fan.

5. The method of claim 3, further comprising the steps of:

choosing the one of the inlet manifold air temperature error signal, engine coolant temperature error signal, hydraulic sump temperature error signal, and transmission lube oil temperature error signal with the highest value as the controlling temperature signal; and choosing a default value for any of the inlet manifold air temperature error signal, engine coolant temperature error signal, hydraulic sump temperature error signal, and transmission lube oil temperature error signal which is unavailable or improper.

6. The method of claim 4, further comprising the steps of:

controlling the fan electrohydraulic valve to operate at the minimum fan limit if the fan current value is unavailable or improper.

7. An apparatus for controlling an engine cooling fan, comprising:

one or more temperature sensors adapted to measure one or more temperatures and responsively produce one or more temperature signals;

an electronic control module adapted to receive the temperature signals and responsively produce a fan current signal;

a fan control device adapted to receive the fan current signal and responsively control a driving force provided to the engine cooling fan; and wherein the fan current signal is limited by at least one of an upper limit value, a lower limit value, and a change rate value.

8. The apparatus of claim 7, wherein the temperatures measured are chosen from a group consisting of an inlet manifold air temperature, an engine coolant temperature, a hydraulic sump temperature, a transmission lube oil temperature, an engine accessory temperature, and a machine accessory temperature.

9. The apparatus of claim 8, wherein the electronic control module calculates the fan current signal by multiplying each of the one or more temperature signals by a predetermined weighting factor to produce a weighted temperature signal for each temperature signal, selecting one of the weighted temperature signals, and producing a desired fan current signal responsive to the selected weighted temperature signal.

10. The apparatus of claim 9, wherein the electronic control module assumes a default temperature signal if one or more temperature signals are unavailable or improper.

11. The apparatus of claim 9, wherein the electronic control module selects the weighted temperature signal with the largest value to be the selected weighted temperature signal.

12. The apparatus of claim 10, wherein the fan current signal is inversely proportional to the resultant speed of the engine cooling fan.

13. The apparatus of claim 12, wherein the fan current signal controls an electrical current to a valve, the valve controls hydraulic power to a pump, the pump drives a motor, and the motor drives the engine cooling fan.

14. A method for use in an engine cooling system for a work machine, comprising the steps of:

generating at least one temperature input signal based on at least one sensed temperature value;

generating a current signal based on at least one temperature input signal;

reading the current signal and responsively controlling power to a cooling member;

providing a default temperature input signal in the event of an unreadable or improper sensed temperature value; and limiting the current signal with an upper limit value, a lower limit value and a change rate value;

reading the current signal and responsively providing a predetermined amount of electrical power to a valve; and providing hydraulic power to a motor driving a cooling member responsively to a position of the valve.

* * * * *